US012311225B2

(12) United States Patent
Weiss

(10) Patent No.: US 12,311,225 B2
(45) Date of Patent: May 27, 2025

(54) BALANCE BOARD WITH VARIABLE FORE-AND-AFT ADJUSTABILITY

(71) Applicant: Scott David Weiss, Boulder, CO (US)

(72) Inventor: Scott David Weiss, Boulder, CO (US)

( * ) Notice: Subject to any disclaimer, the term of this patent is extended or adjusted under 35 U.S.C. 154(b) by 120 days.

(21) Appl. No.: 18/376,804

(22) Filed: Oct. 4, 2023

(65) Prior Publication Data

US 2024/0108942 A1 Apr. 4, 2024

Related U.S. Application Data

(60) Provisional application No. 63/378,348, filed on Oct. 4, 2022.

(51) Int. Cl.
*A63B 22/16* (2006.01)

(52) U.S. Cl.
CPC ..... *A63B 22/16* (2013.01); *A63B 2208/0204* (2013.01)

(58) Field of Classification Search
CPC ..... A63B 22/16; A63B 2208/0204; A63B 2071/0072; A63B 69/0093; A63B 26/003; A63B 22/14; A63B 22/18
See application file for complete search history.

(56) References Cited

U.S. PATENT DOCUMENTS 2,764,411 A * 9/1956 Washburn, Jr. ..... A63B 22/16 482/146
4,505,477 A * 3/1985 Wilkinson ..... A63C 17/08 280/87.041
4,601,469 A * 7/1986 Sasser, Jr. ..... A63B 22/16 482/146
4,826,159 A * 5/1989 Hersey ..... A63B 26/003 482/146
4,911,440 A * 3/1990 Hyman ..... A63B 22/16 482/146
5,152,691 A * 10/1992 Moscarello ..... A63B 22/16 482/146
5,190,506 A * 3/1993 Zubik ..... A63B 22/16 482/68

(Continued)

OTHER PUBLICATIONS

Vew-Do, Vew-Do Balance Boards—El Dorado, Retrieved From Internet, Retrieved on Oct. 4, 2023, <URL: https://www.amazon.in/Vew-Do-Balance-Boards-El-Dorado/dp/B01M3WH18W>.

(Continued)

*Primary Examiner* — Nyca T Nguyen

(57) ABSTRACT

A balance board with variable fore-and-aft adjustability is an apparatus that enables users to perform balance training with a forward-leaning posture requiring different fore-and-aft weight distribution. The apparatus includes a board body, a rail, a first rail support, a second rail support, a rolling fulcrum, a plurality of first slots, and a plurality of second slots. The board body serves as a platform on which the user can stand for balance training. The first rail support and the second rail support enable the attachment of the rail in different settings to practice different postures of markedly varying fore-and-aft weight distribution. The rail enables the board body to linearly roll on the rolling fulcrum. The plurality of first slots and the plurality of second slots enable the adjustment of the positioning of the rail. The rolling fulcrum with an annular groove facilitates the balance training of a forward-leaning posture.

20 Claims, 22 Drawing Sheets

(56) References Cited

U.S. PATENT DOCUMENTS

| | | | | | |
|---|---|---|---|---|---|
| 5,545,115 | A * | 8/1996 | Corcoran | A63B 22/16 | 482/146 |
| D376,629 | S * | 12/1996 | Mounts | D21/412 | |
| 6,916,276 | B1 * | 7/2005 | Robinson | A63B 69/0093 | 482/80 |
| 7,479,097 | B2 * | 1/2009 | Rosborough | A63B 22/203 | 482/146 |
| 2013/0123077 | A1 * | 5/2013 | Dunegan | A63B 21/0442 | 482/139 |
| 2019/0247735 | A1 * | 8/2019 | Kap, II | A63B 69/0093 | |
| 2020/0094107 | A1 * | 3/2020 | Mrzlak | A63B 22/16 | |

OTHER PUBLICATIONS

Revolution Balance Boards, Revbalance 101 v2—Balance Board Sports Trainer, Retrieved From Internet, Retrieved On Oct. 4, 2023, <URL: https://www.amazon.com/dp/B00AAXD6X0?tag=yakskate-20&th=1>.

Swifty Scooters, Swifty Balance Board, Roller & Wall Bracket/Floor Stand Bundle, Retrieved From Internet, Retrieved On Oct. 4, 2023, <URL: https://swiftyscooters.com/products/swifty-balance-board-bundle>.

* cited by examiner

BALANCE BOARD WITH VARIABLE FORE-AND-AFT ADJUSTABILITY

The current application claims a priority to the U.S. provisional patent application Ser. No. 63/378,348 filed on Oct. 4, 2022.

FIELD OF THE INVENTION

The present invention relates generally to training and exercise equipment. More specifically, the present invention provides a balance board with variable fore-and-aft adjustability that helps improve the user's balance, fitness, and athleticism.

BACKGROUND OF THE INVENTION

Nowadays, various tools and devices have been made available to help people work on their balance, such as balance boards. In general, a balance board includes an elongated platform that is balanced over a rolling fulcrum. The user positions their body on the platform to maintain their balance as the platform tends to roll over the rolling fulcrum. Further, current balance boards have a fulcrum that rolls along the middle of the platform which positions the user's center of gravity or balance point over the arches of the user's feet or over the user's heels. However, most athletes utilize a forward-leaning posture where the center of gravity is located over the balls or toes of their feet. This is the posture that is utilized in most sports including, but not limited to, running, skiing, etc. Therefore, there is a need for a balance board that allows the user to train their balance while utilizing the forward-leaning posture and other body positions used in their sport. Further, it would be advantageous to allow a user to customize the exact location of the balance point or center of gravity on the balance board.

An objective of the present invention is to provide a balance board with variable fore-and-aft adjustability that enables users to practice different body postures using the same balance board. The present invention enables users to adjust the position of the fulcrum in order to train different body postures that position the body's center of gravity at different locations, such as training a forward-leaning posture for Alpine skiing. Another objective of the present invention is to provide a balance board with variable fore-and-aft adjustability that can be easily adjusted by the user without the use of additional tools. Additional features and benefits of the present invention are further discussed in the sections below.

SUMMARY OF THE INVENTION

The present invention is a balance board with variable fore-and-aft adjustability. The balance board with variable fore-and-aft adjustability enables the users to practice different body postures that require the body's center of gravity to be positioned at different locations for optimal training. To do so, the present invention includes a board body that serves as the platform on which the user can stand on. The board is mounted on a rolling fulcrum that enables the board body to move as the user trains their balance at the desired forward-leaning posture. Further, an adjustable rail system enables the controlled movement of the board body on top of the rolling fulcrum. The adjustable rail system also enables the user to control the position of the rolling fulcrum at different positions that can be parallel to a central axis of the board body that forces the user to maintain a forward-leaning posture while maintaining their balance.

The users can adjust the adjustable rail system to a "center setting" for a traditional balance board experience that centers the user more or less over the arch of the foot or adjust the adjustable rail system to a "forward setting" to train an advanced "forward posture" approach while on the board body. The forward setting helps create the awareness of the proper body positioning that is needed to advance the user's training. Further, the adjustable rail system is preferably designed to be quickly adjusted by the user without the use of additional tools or devices so that the user can adjust the present invention on the fly without largely disrupting their training. Furthermore, the board body of the present invention can be equipped with anti-slip material to provide the user with the necessary traction for the user's feet on the board. The anti-slip material ensures stability and balance for the user, even during the most challenging workouts.

DETAILED DESCRIPTION OF THE INVENTION

Figure 1:
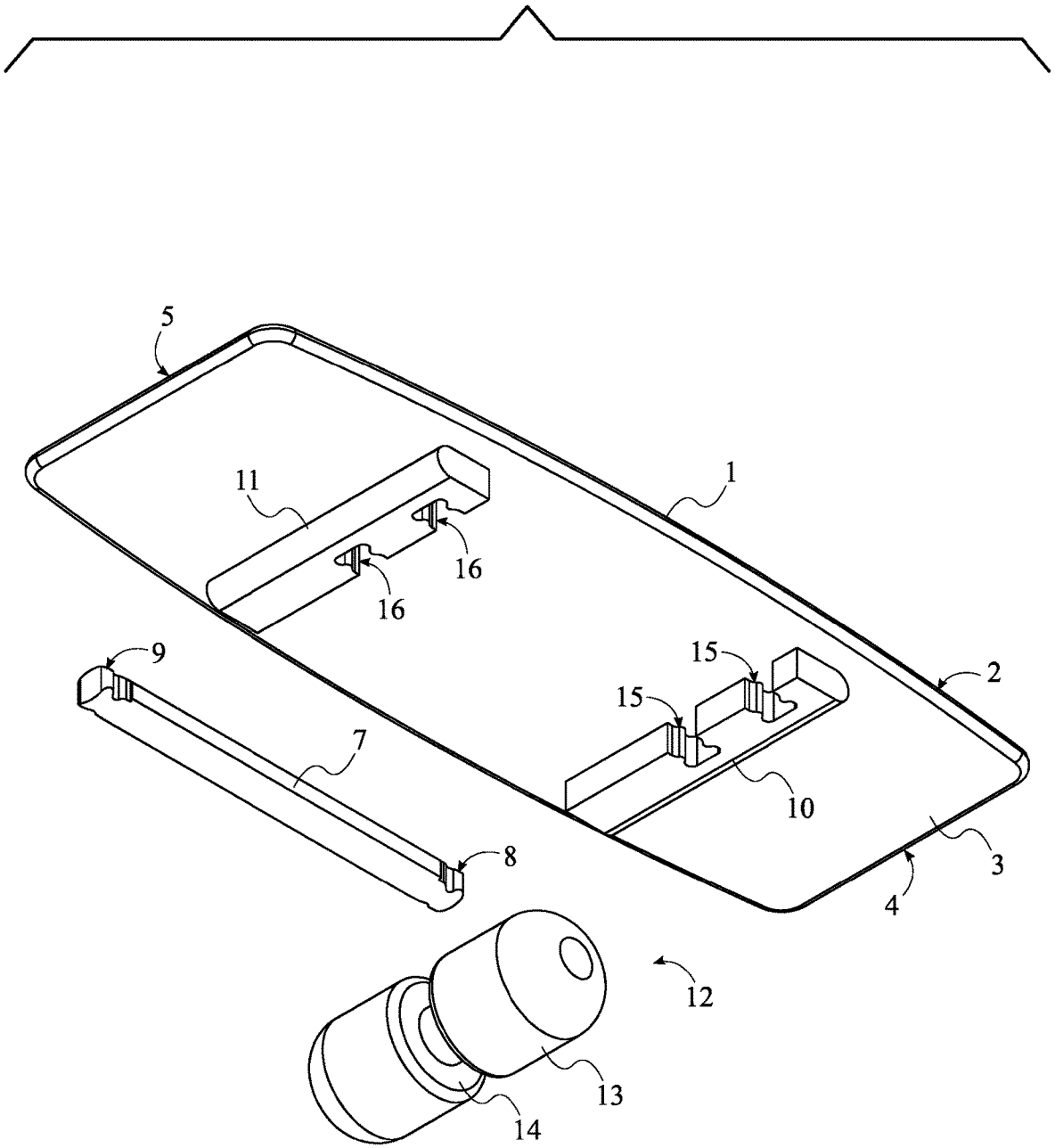
FIG. 1 is a bottom-rear-exploded perspective view of the present invention.

All illustrations of the drawings are for the purpose of describing selected versions of the present invention and are not intended to limit the scope of the present invention.

The present invention is a balance board with variable fore-and-aft adjustability that enables users to perform different balance training exercises that help improve different body postures. As can be seen in FIGS. 1 through 13, the present invention comprises a board body 1, at least one rail 7, a first rail support 10, a second rail support 11, a rolling fulcrum 12, a plurality of first slots 15, and a plurality of second slots 16. The board body 1 serves as a platform on which the user can stand for balance training of different body postures. The first rail support 10 and the second rail support 11 enable the releasable attachment of the at least one rail 7. The at least one rail 7 enables the board body 1 to securely rest on the rolling fulcrum 12 for the balance training. The plurality of first slots 15 and the plurality of second slots 16 enable the select adjustment of the positioning of the at least one rail 7 on the first rail support 10 and the second rail support 11, respectively. The rolling fulcrum 12 facilitates the balance training of the body posture that the user wants to work on.

The general configuration of the aforementioned components enables users to perform balance training of different body postures that require different positioning of the body's center of gravity. As can be seen in FIGS. 1 through 13, the board body 1 is preferably an elongated and thin piece of material strong enough to support the user's body. The board body 1 generally has an overall rectangular shape with curved edges for a more appealing ornamental look. For example, the board body 1 can be made from strong and durable Canadian Maple wood and be designed to up to 300 pounds. The board body 1 can also measure 30 inches (in.) in length, 12 in. in width, and half-an-inch in thickness to provide the right amount of surface area for use with a variety of standing orientations. Further, the board body 1 comprises a first board face 2 and a second board face 3 corresponding to the opposite flat surfaces of the board body 1. The at least one rail 7 is an elongated tubular structure with a length smaller than the length of the board body 1. In addition, the at least one rail 7 comprises a first rail end 8 and a second rail end 9 corresponding to the terminal ends of the at least one rail 7.

In the preferred embodiment, the present invention has the following arrangement of components. As can be seen in FIGS. 1 through 10, the first rail support 10 and the second rail support 11 are positioned parallel to each other to align the plurality of first slots 15 with the plurality of second slots 16. The first rail support 10 and the second rail support 11 are also positioned offset from each other to leave a space to accommodate the at least one rail 7. In addition, the first rail support 10 and the second rail support 11 are mounted onto the second board face 3 to secure the first rail support 10 and the second rail support 11 to the board body 1. Further, the plurality of first slots 15 is distributed along the first rail support 10 to accommodate the different settings of the at least one rail 7. The plurality of first slots 15 is also laterally integrated into the first rail support 10 to provide spaces that can releasably retain the first rail end 8. In addition, the plurality of first slots 15 is oriented towards the second rail support 11 so that the at least one rail 7 can be secured between the first rail support 10 and the second rail support 11. Similarly, the plurality of second slots 16 is distributed along the second rail support 11 to accommodate the different settings of the at least one rail 7. The plurality of second slots 16 is also laterally integrated into the second rail support 11 to provide spaces that can releasably retain the second rail end 9. In addition, the plurality of second slots 16 is oriented towards the first rail support 10 so that the at least one rail 7 can be secured between the first rail support 10 and the second rail support 11. Further, each of the plurality of first slots 15 is positioned in line with a corresponding second slot 18 from the plurality of second slots 16 which positions the at least one rail 7 in a parallel position in relation to the length of the board body 1. Further, a specific first slot 17 from the plurality of first slots 15 is releasably engaged by the first rail end 8 to secure the at least one rail 7 to the first rail support 10. Likewise, the corresponding second slot 18 from the plurality of second slots 16 is releasably engaged by the second rail end 9 to also secure the at least one rail 7 to the second rail support 11. Furthermore, the rolling fulcrum 12 is rollably mounted along the at least one rail 7, opposite to the board body 1, so that the board body 1 can rest on the rolling fulcrum 12. This way, the user can stand on the board body 1 with a desired body posture for balance training by balancing the user's body on the rolling fulcrum 12. Further, selecting settings are designed to force the user to have a forward-leaning posture while maintaining good balance.

Figure 3:
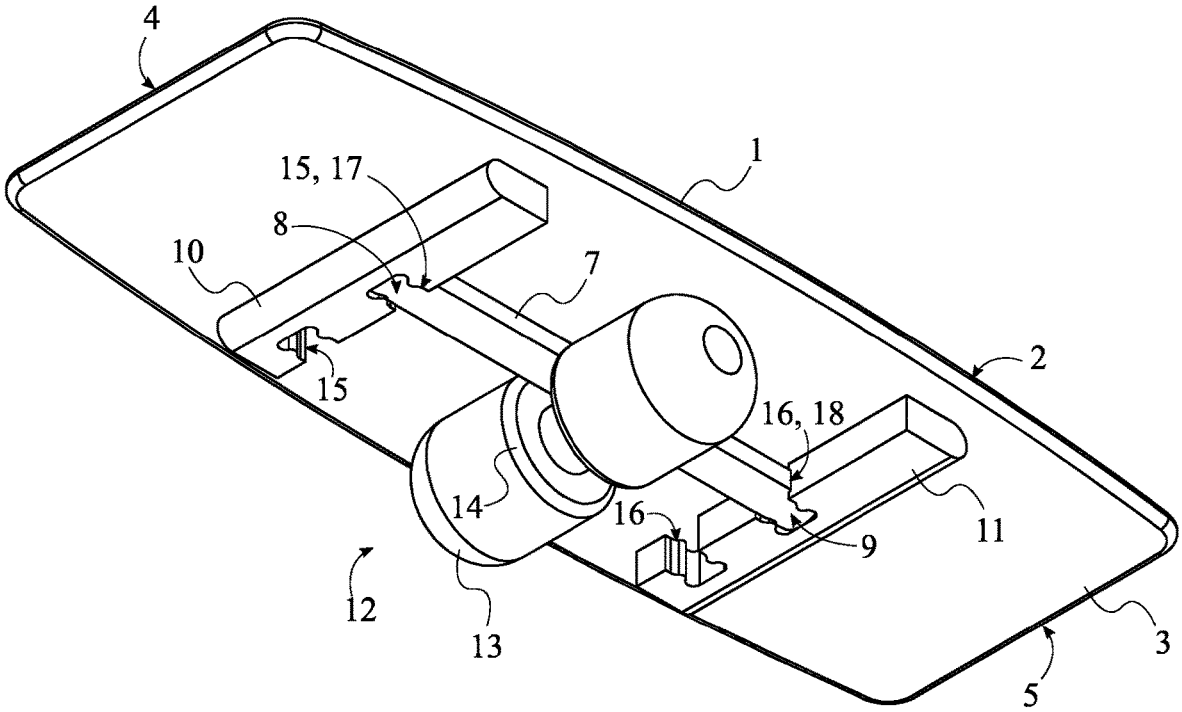
FIG. 3 is a bottom-front perspective view of the present invention.
Figure 4:
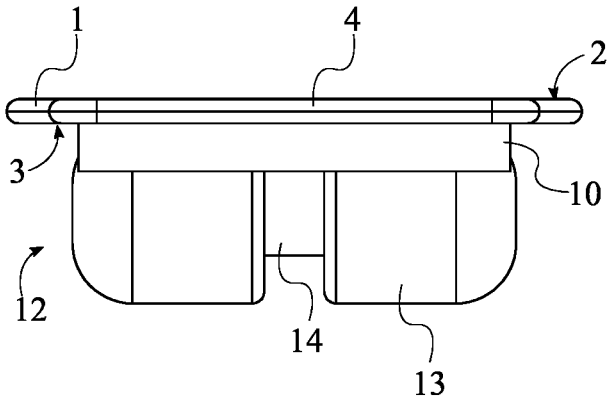
FIG. 4 is a front view of the present invention.
Figure 5:
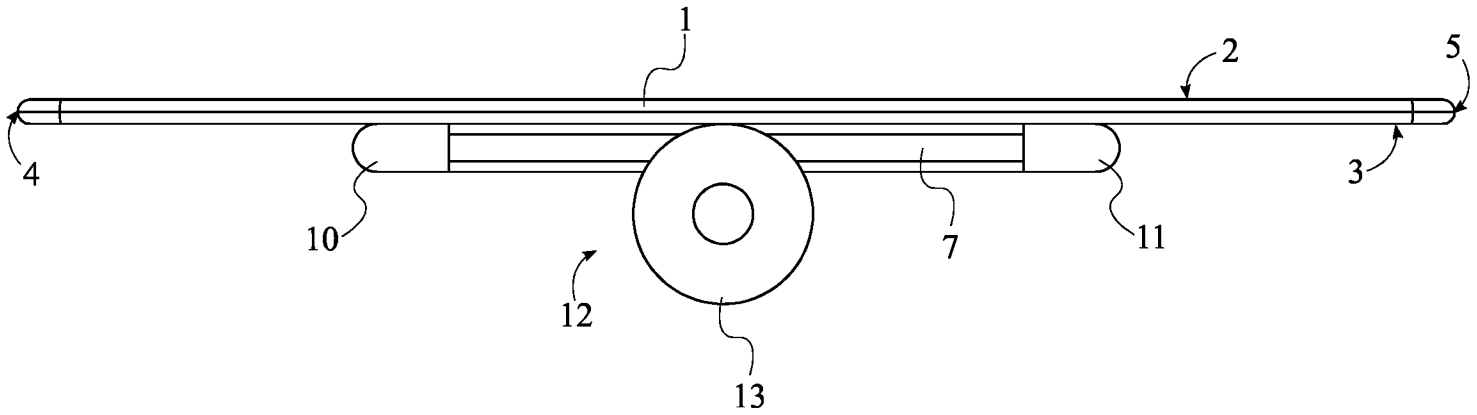
FIG. 5 is a side view of the present invention.
Figure 6:
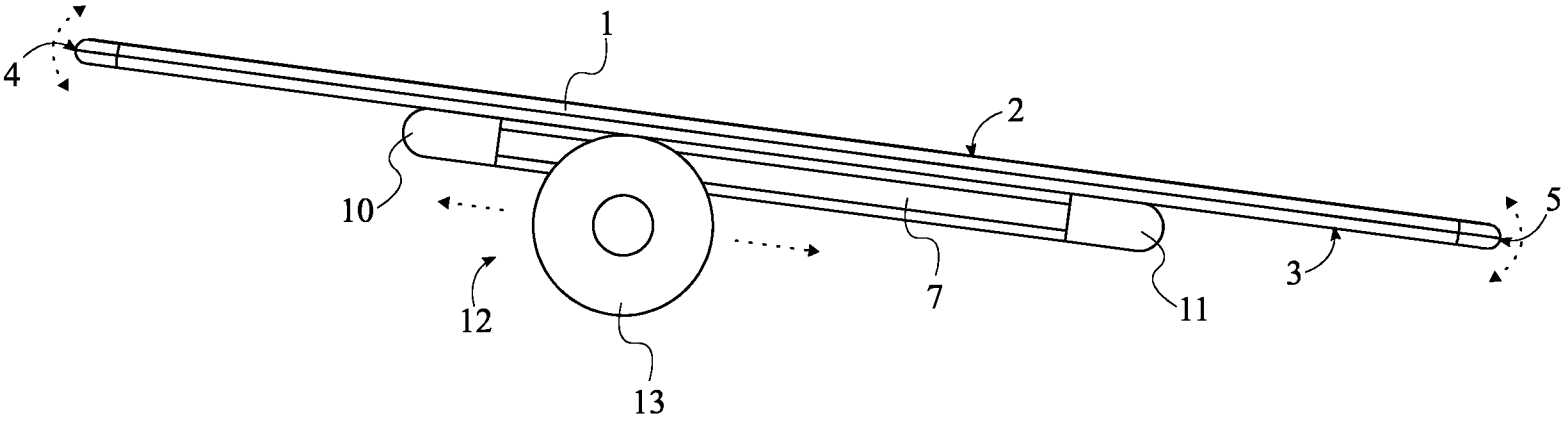
FIG. 6 is a side view of the present invention, wherein the board body is shown moved on the rolling fulcrum in a first direction.
Figure 7:
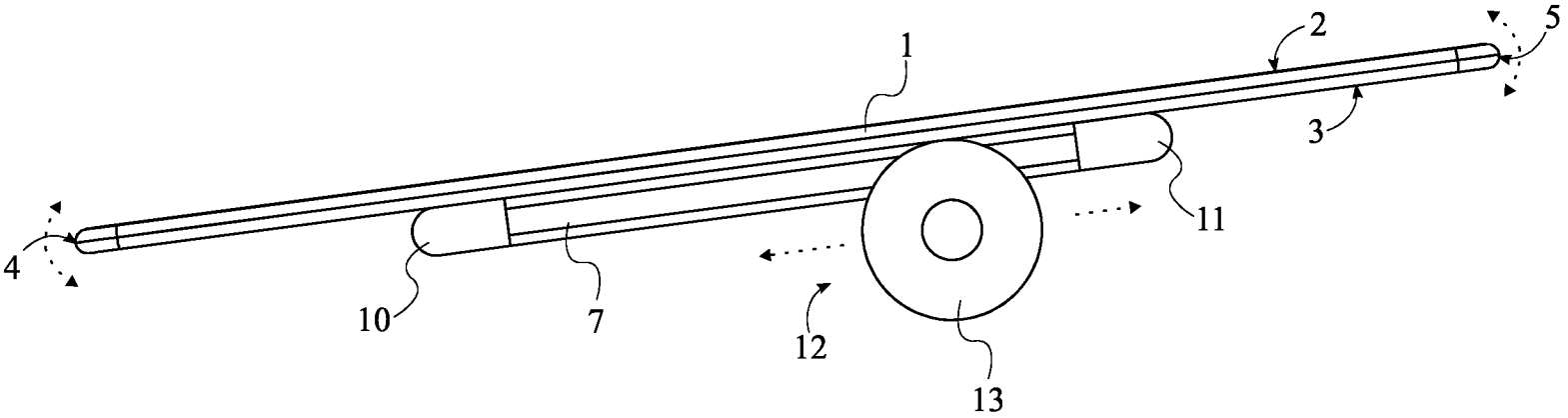
FIG. 7 is a side view of the present invention, wherein the board body is shown moved on the rolling fulcrum in a second direction.
Figure 8:
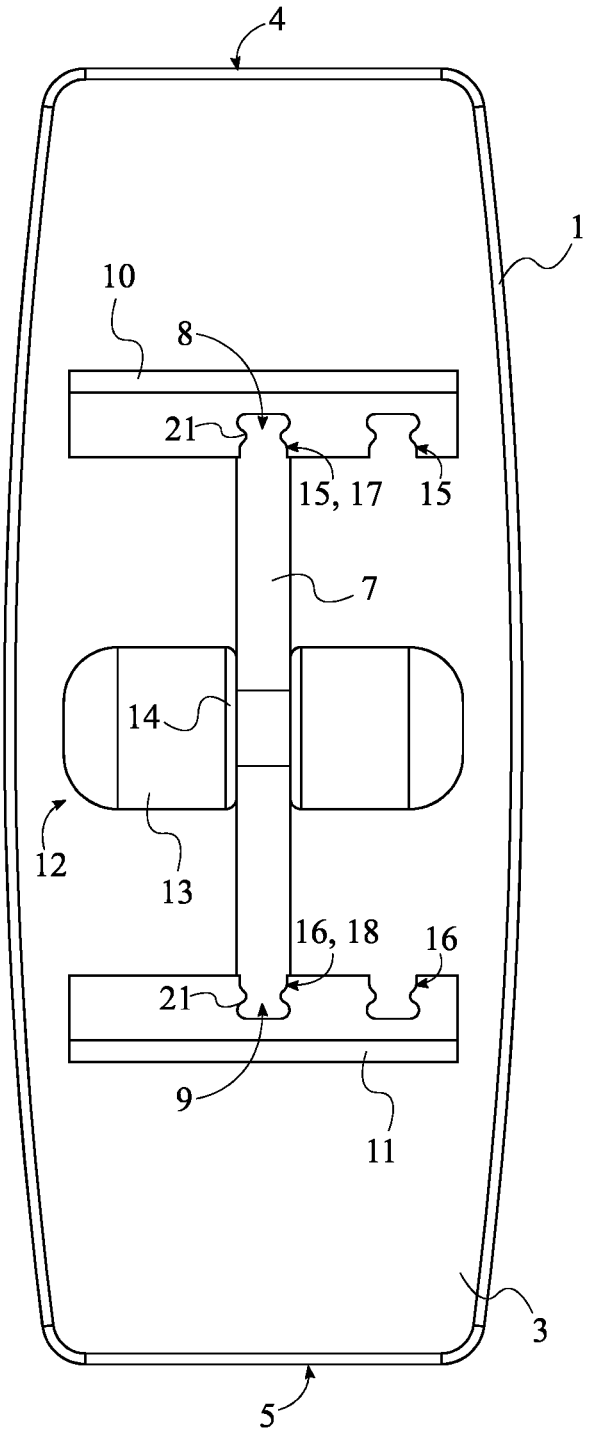
FIG. 8 is a bottom view of the present invention.
Figure 9:
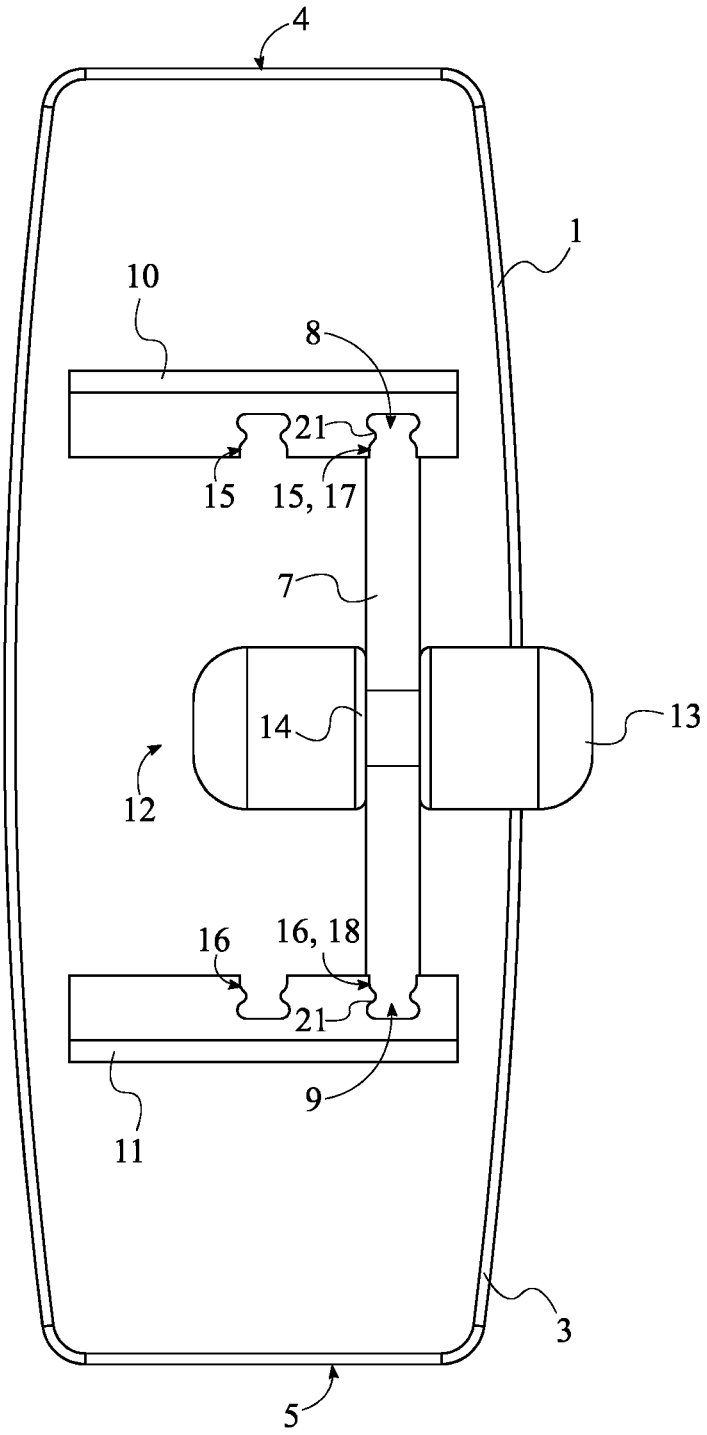
FIG. 9 is a bottom view of the present invention, wherein the rail and the rolling fulcrum are shown in an alternate configuration.
Figure 10:
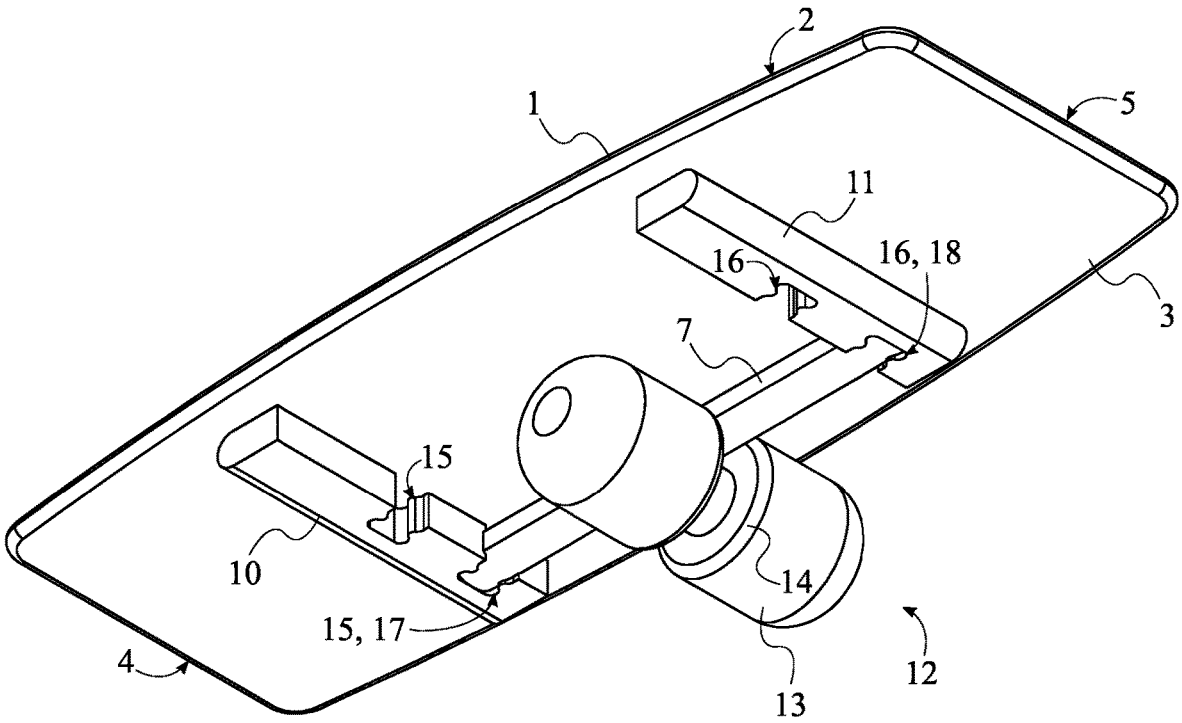
FIG. 10 is a bottom-rear perspective view of the alternate configuration of the present invention.
Figure 11:
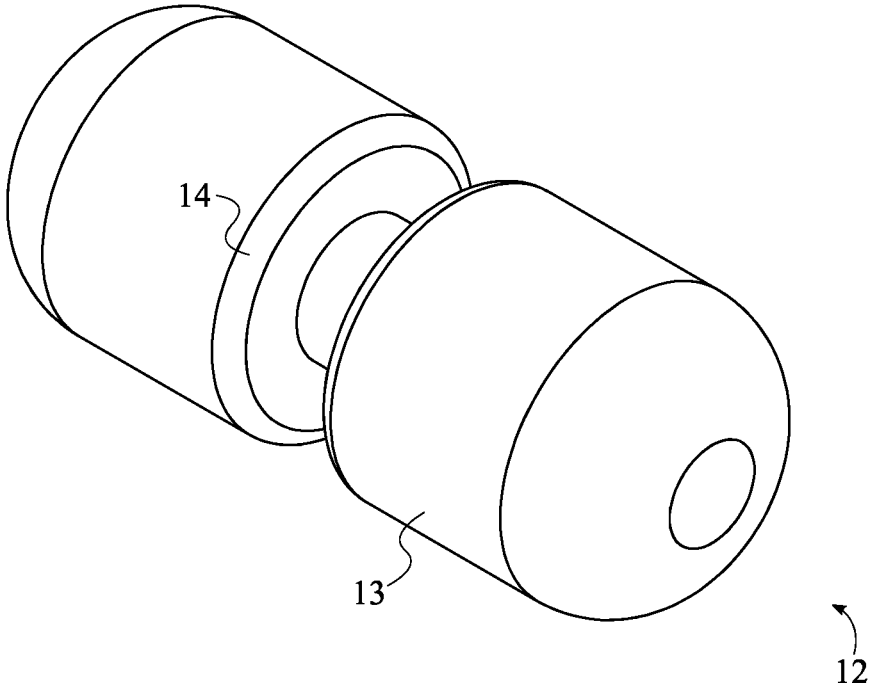
FIG. 11 is a top-front perspective view of the rolling fulcrum of the present invention.
Figure 12:
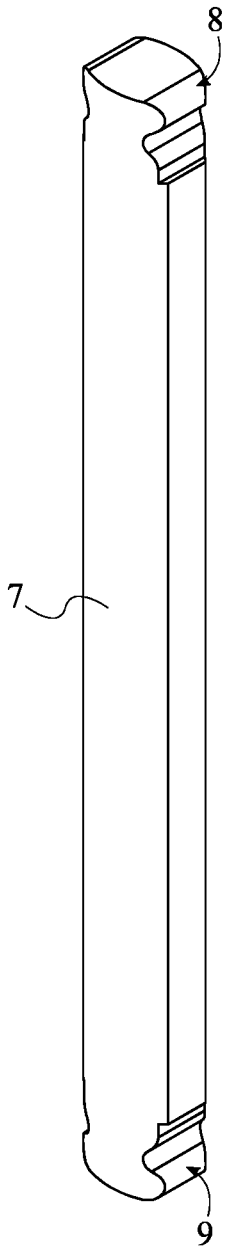
FIG. 12 is a top-front perspective view of the rail of the present invention.
Figure 13:
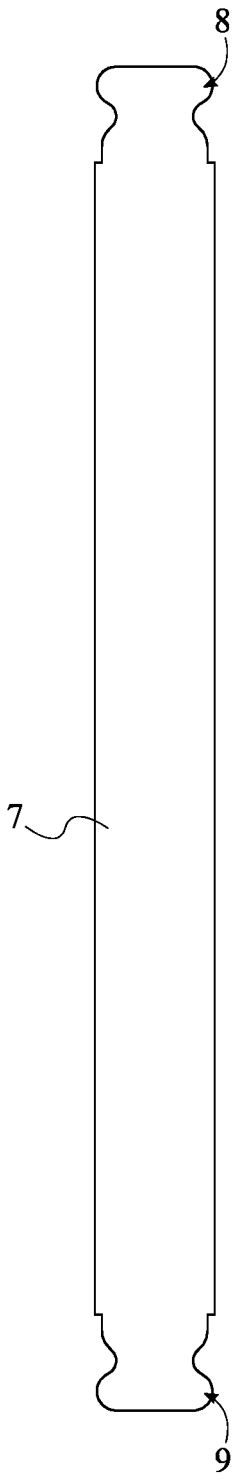
FIG. 13 is a front view of the rail of the present invention.

As previously discussed, the present invention enables the user to practice different body postures. For example, as can be seen in FIGS. 3 and 8, the user can center the at least one rail 7 on the first rail support 10 and the second rail support 11 for a traditional balance board experience. The first rail end 8 is engaged with a center first slot on the first rail support 10. Likewise, the second rail end 9 is engaged with a center second slot on the second rail support 11. This way, the present invention can be used as a traditional balance board. Further, the present invention can be used to practice a "forward posture." For example, as can be seen in FIGS. 9 and 10, the user can position the at least one rail 7 closer to a lengthwise edge of the board body 1 to help create the awareness of the proper body positioning that is needed to, for example, advance the awareness of the appropriate body positioning for a sport such as Alpine Skiing. The first rail end 8 is engaged with an outer first slot on the first rail support 10. Likewise, the second rail end 9 is engaged with an outer second slot on the second rail support 11. This way, the present invention can be used to practice balancing with a forward-leaning posture. In other embodiments, the present invention can provide additional settings to practice different body postures.

Figure 2:
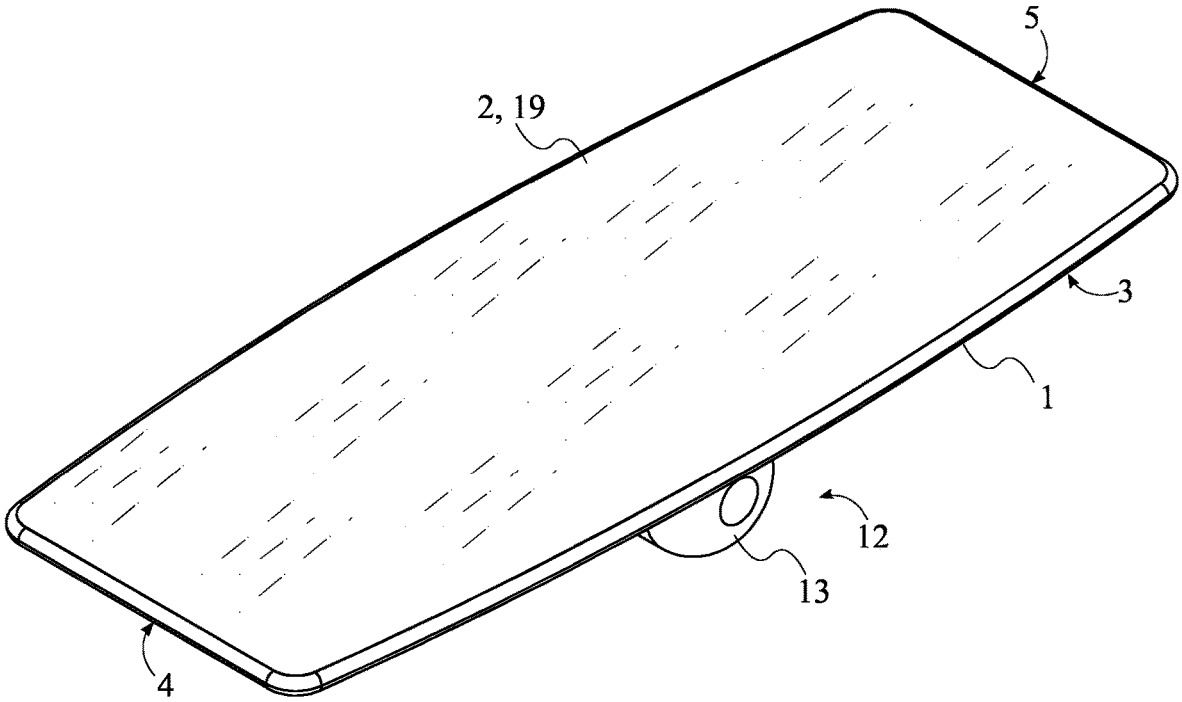
FIG. 2 is a top-front perspective view of the present invention.

In the preferred embodiment, the present invention can also include gripping material that provides the necessary traction for the user's feet on the board body 1. As can be seen in FIG. 2, the present invention may further comprise an anti-slip layer 19. The anti-slip layer 19 is preferably a stylish grip tape with a unique "landscape" design, classic logo, or blank design to provide the user with stability and balance, even during the most challenging workouts. To do so, the anti-slip layer 19 is adhered across the first board face 2 to secure the anti-slip layer 19 to the board body 1. Further, the anti-slip layer 19 is coextensive with the first board face 2 to cover the whole first board face 2.

Figure 14:
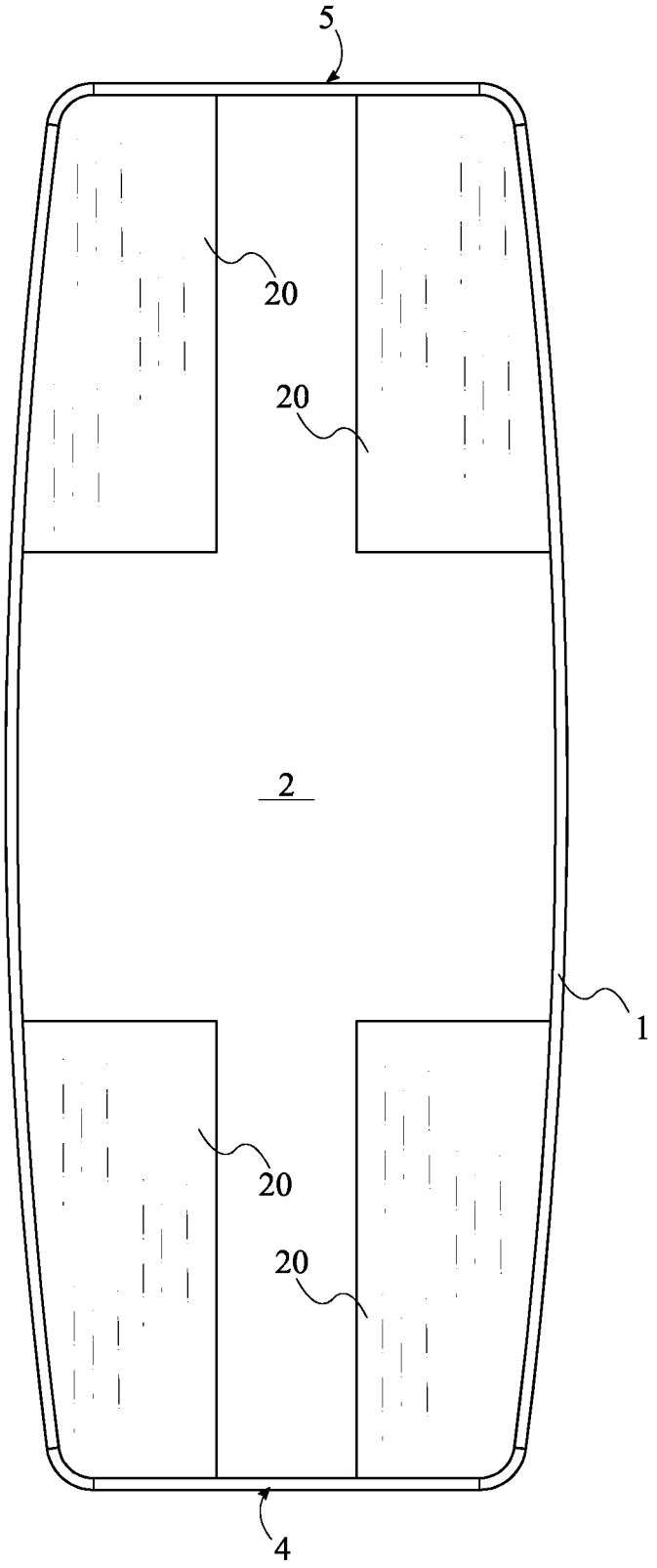
FIG. 14 is a top view of the board body of the present invention, wherein the board body is shown with a plurality of anti-slip features.

In an alternate embodiment, the present invention may include several sections of gripping material across the board body 1 so that the user's feet are comfortably stable on specific sections on the board body 1. As can be seen in FIG. 14, the present invention may further comprise a plurality of anti-slip features 20. Like the anti-slip layer 19, the plurality of anti-slip features 20 can be sections of the same stylish grip tape of different shapes and sizes distributed across the board body 1. So, the plurality of anti-slip features 20 is distributed across the first board face 2. Further, the plurality of anti-slip features 20 is adhered onto the first board face 2 to secure the plurality of anti-slip features 20 to the board body 1. In other embodiments, different gripping features or other safety devices can be provided on the board body 1.

Figure 15:
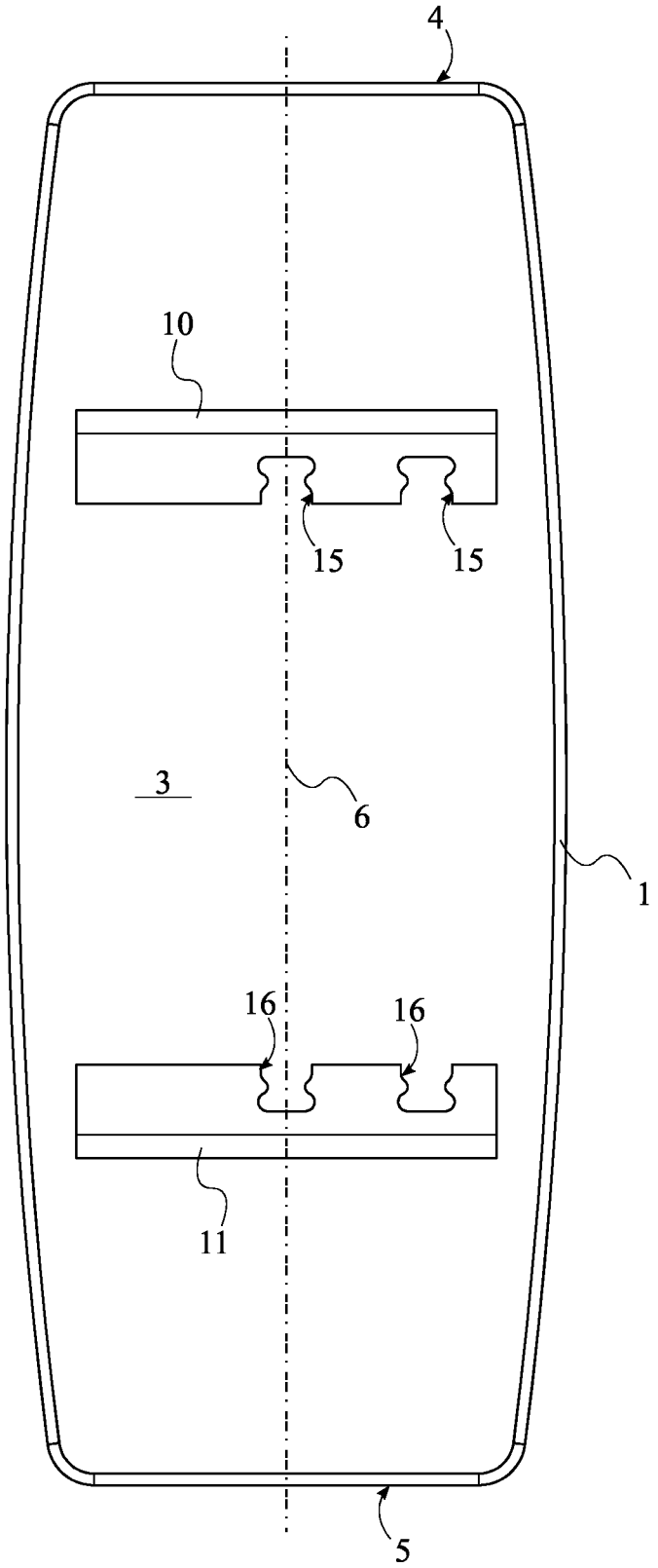
FIG. 15 is a bottom view of the board body of the present invention.
Figure 16:
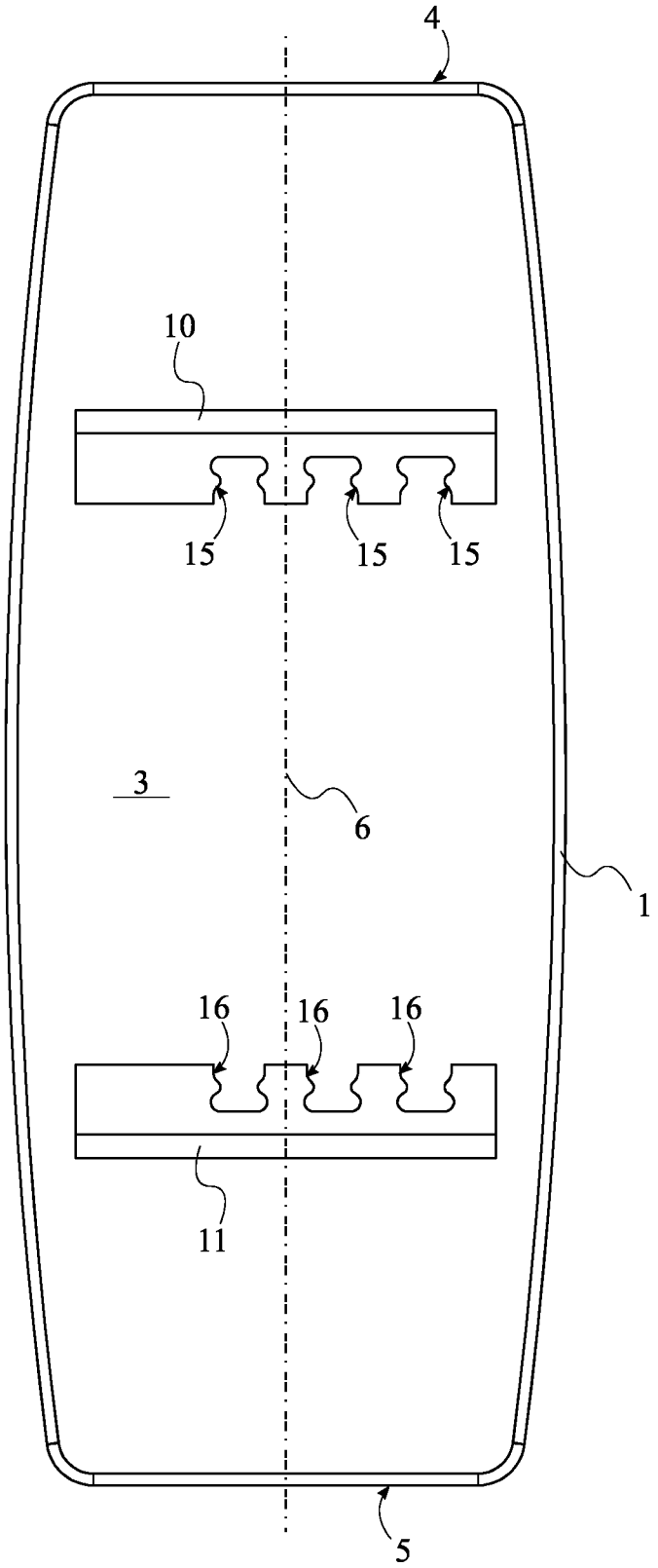
FIG. 16 is a bottom view of the board body of the present invention, wherein alternate embodiments of the first rail support and the second rail support are shown.
Figure 17:
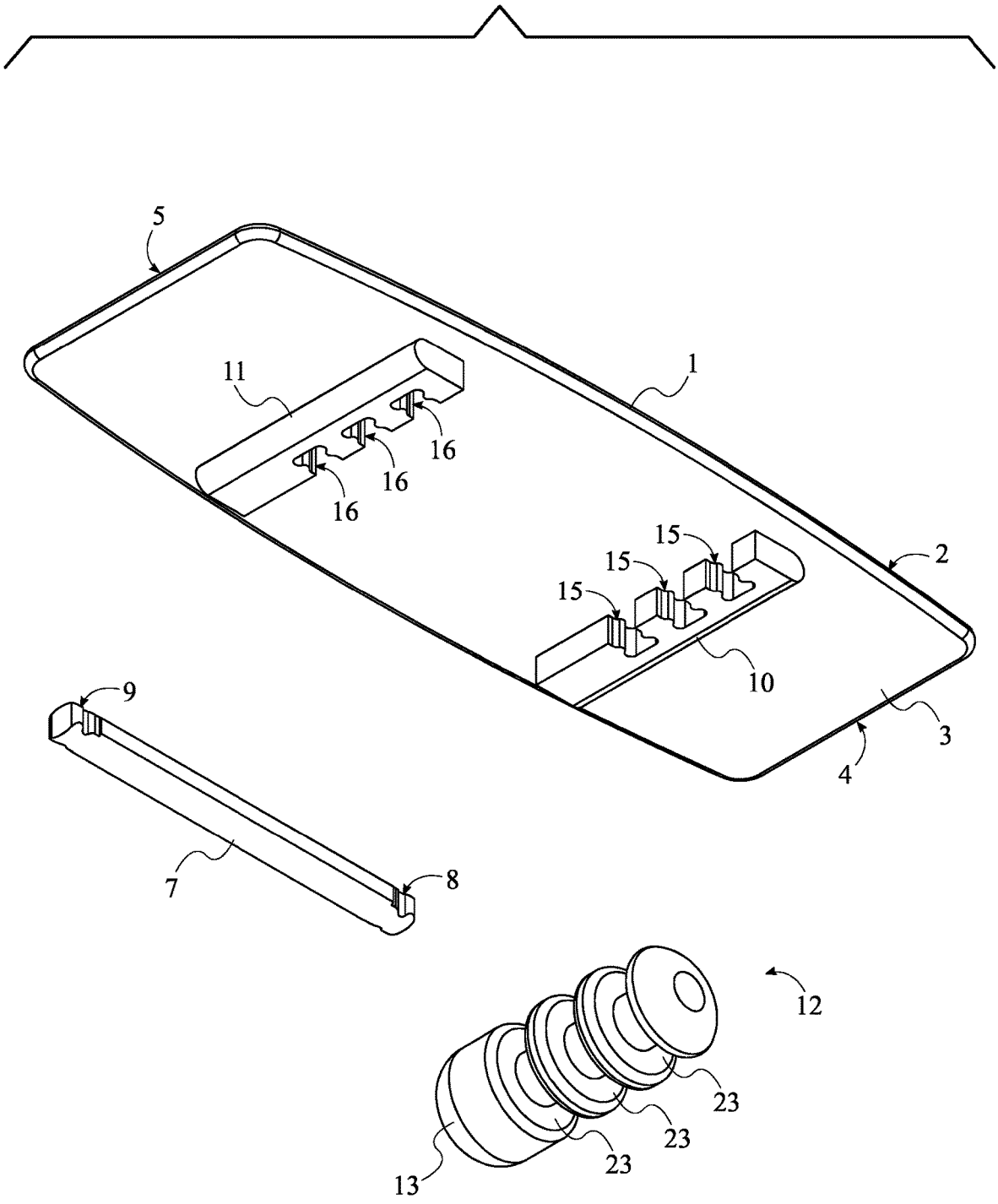
FIG. 17 is a bottom-front-exploded perspective view of the present invention with the alternate embodiments of the first rail support, the second rail support, and the rolling fulcrum.
Figure 18:
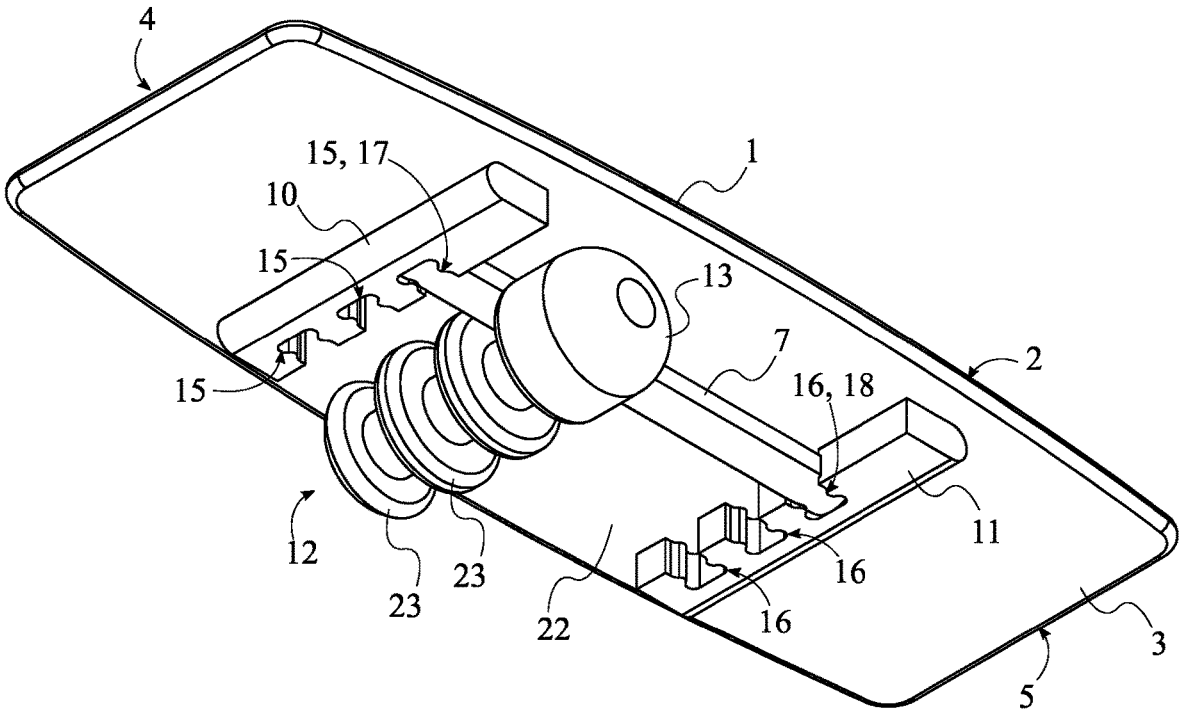
FIG. 18 is a bottom-front perspective view of the present invention with the alternate embodiments of the first rail support, the second rail support, and the rolling fulcrum.
Figure 19:
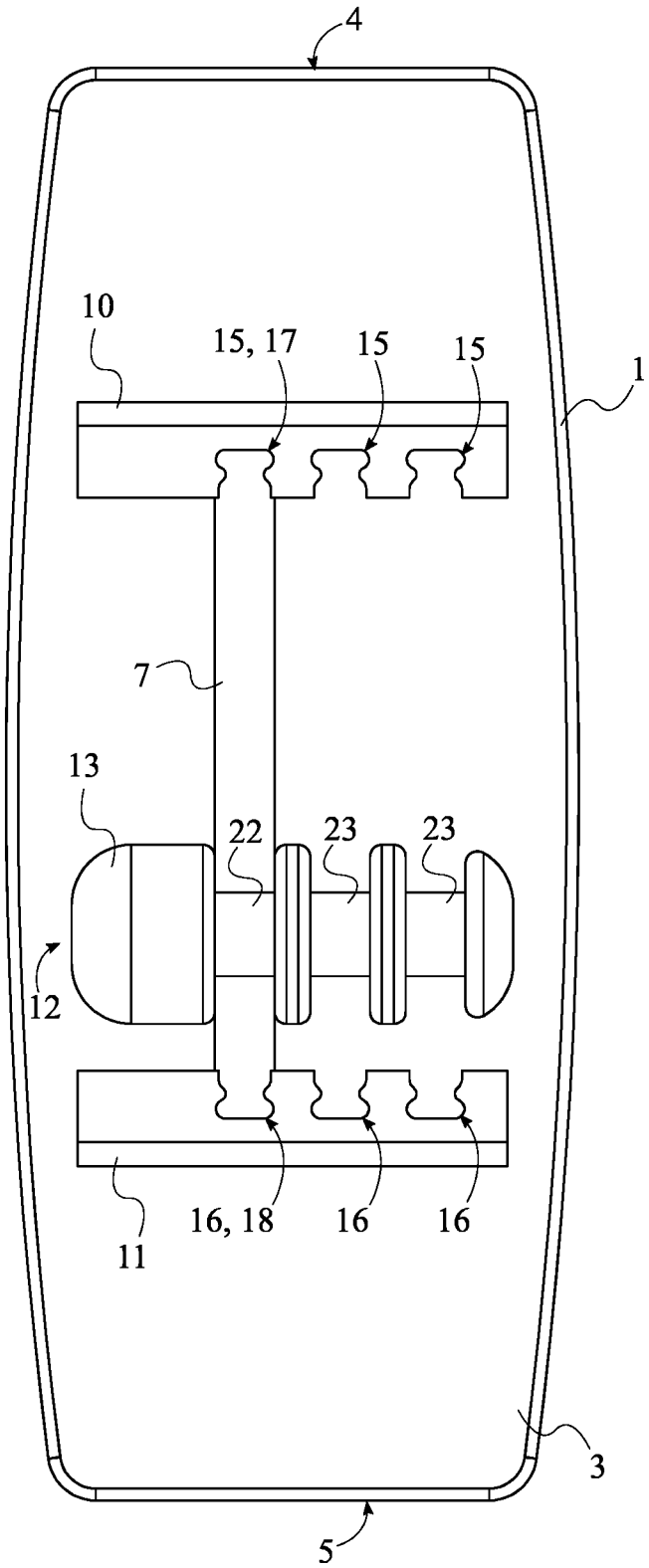
FIG. 19 is a bottom view of the present invention with the alternate embodiments of the first rail support, the second rail support, and the rolling fulcrum.
Figure 20:
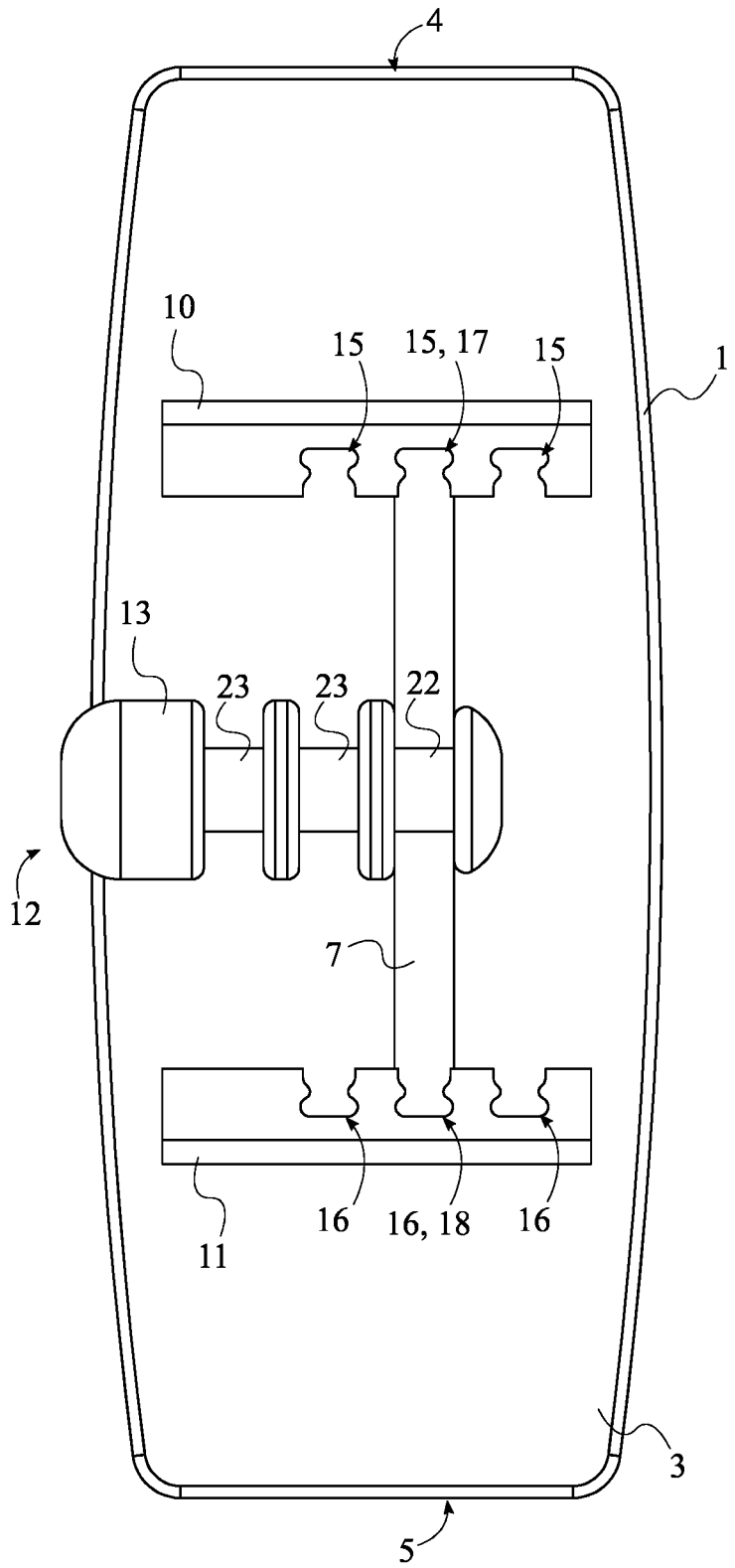
FIG. 20 is a bottom view of the present invention with the alternate embodiments of the first rail support, the second rail support, and the rolling fulcrum, and wherein the rail is shown engaged with an alternate annular groove.
Figure 21:
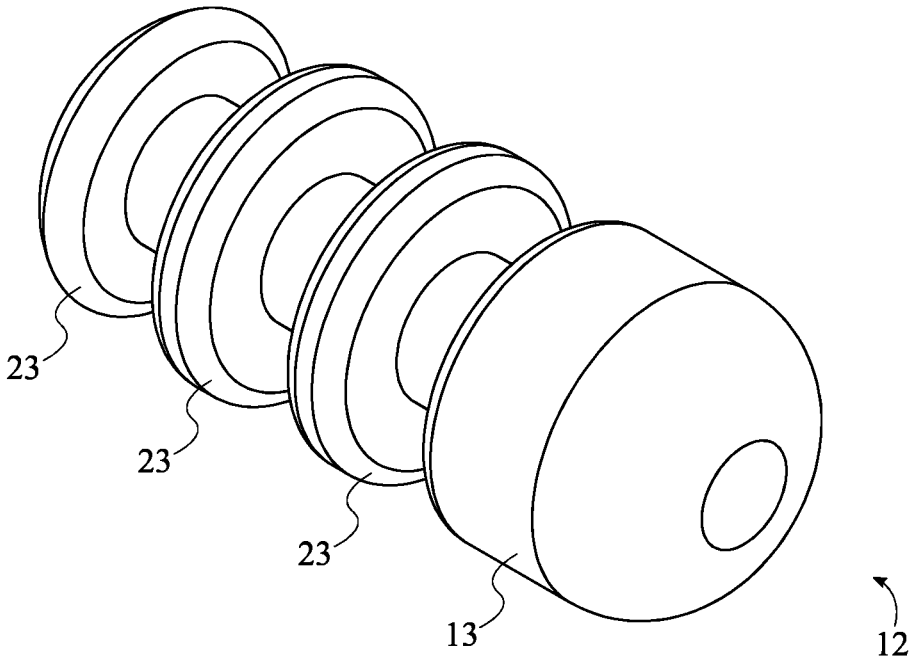
FIG. 21 is a top-front perspective view of the alternate embodiment of the rolling fulcrum of the present invention.
Figure 22:
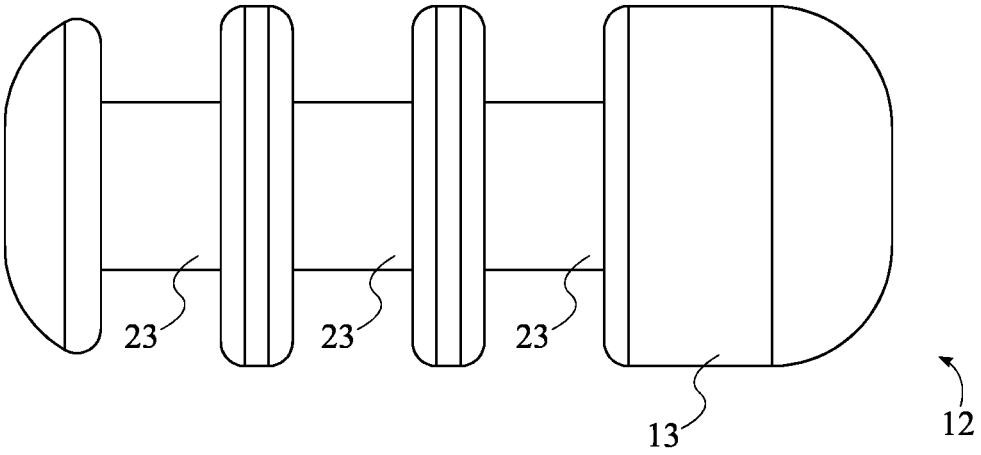
FIG. 22 is a front view of the alternate embodiment of the rolling fulcrum of the present invention.

As previously discussed, the first rail support 10 and the second rail support 11 are arranged to keep the at least one rail 7 in an overall parallel orientation with the board body 1 so that the board body 1 can be balanced on the rolling fulcrum 12 by the user in a specific, linear direction. As can be seen in FIGS. 15 and 16, the board body 1 may further comprise a first board end 4 and a second board end 5 preferably corresponding to the shorter edges of the board body 1. To orient the at least one rail 7 parallel to the overall board body 1, the first rail support 10 and the second rail support 11 are positioned perpendicular to a central lengthwise axis 6 of the board body 1. In addition, the first rail support 10 is positioned offset from the first board end 4 while the second rail support 11 is positioned offset from the second board end 5. This way, when the at least one rail 7 is secured to the first rail support 10 and the second rail support 11 at any setting, the at least one rail 7 is oriented parallel to the central lengthwise axis 6 of the board body 1. The user then must balance the user's body on the rolling fulcrum 12 only along the central lengthwise axis 6 of the board body 1.

The present invention is designed so that the adjustment of the position of the at least one rail 7 can be performed without the use of additional tools. As can be seen in FIGS. 8, 9, 15, 16, 19, and 20, the plurality of first slots 15 and the plurality of second slots 16 are designed to securely retain the first rail end 8 and the second rail end 9, respectively, in a releasable manner. For example, the plurality of first slots 15 and the plurality of second slots 16 can have a cross-sectional design that is longitudinally symmetrical but latitudinally asymmetric. So, a transversal cross-sectional shape 21 of each of the plurality of first slots 15 is configured to receive a transversal cross-sectional shape 21 of the first rail end 8. Likewise, a transversal cross-sectional shape 21 of each of the plurality of second slots 16 is configured to receive a transversal cross-sectional shape 21 of the second rail end 9. This way, the rail ends can be inserted into the slots by pressing the rail end into the corresponding slot with little effort and removed in the same manner. The cross-sectional design of the plurality of first slots 15 and the plurality of second slots 16 also prevents the rotation of the at least one rail 7 when the at least one rail 7 is secured to the first rail support 10 and the second rail support 11. In other embodiments, the plurality of first slots 15 and the plurality of second slots 16 can be designed to retain the first rail end 8 and the second rail end 9, respectively, in a snap-fit like manner, to further secure the at least one rail 7.

As previously discussed, the rolling fulcrum 12 is designed to enable the user to perform balance training by balancing the board body 1 on the rolling fulcrum 12. To ensure the safety of the user, the rolling fulcrum 12 is designed to only roll along the at least one rail 7. To do so, the rolling fulcrum 12 can be a wooden roller with a center groove that guides the rolling fulcrum 12 along the at least one rail 7, but different materials can be utilized. As can be seen in FIGS. 5 through 11, the rolling fulcrum 12 may comprise a fulcrum body 13 and at least one annular groove 14. The fulcrum body 13 preferably corresponds to the overall cylindrical body of the rolling fulcrum 12. The at least one annular groove 14 is designed to allow for lateral tracking of the board body 1, facilitates fore-and-aft rolling, and minimizes the chances of a board body 1 spinout. In addition, the fulcrum body 13 can have a diameter of 3.75 in. and a length of 9.25 in. The cylindrical ends of the fulcrum body 13 can also be rounded. So, the at least one annular groove 14 is laterally integrated around the fulcrum body 13 to form the groove on the fulcrum body 13. In addition, the at least one annular groove 14 is centrally positioned along the fulcrum body 13 to allow for the perfect balance of the board body 1 on the rolling fulcrum 12. Thus, the at least one annular groove 14 can be rollably engaged along the at least one rail 7 so that the rolling fulcrum 12 only rolls along the length of at least one rail 7 to prevent spinning or separation of the board body 1 with the rolling fulcrum 12.

In alternate embodiments, the present invention can provide means to further adjust the fore-aft postures the user can balance train. To do so, the rolling fulcrum 12 can be manufactured to accommodate the at least one rail 7 at different locations along the fulcrum body 12. As can be seen in FIGS. 16 through 22, the at least one annular groove 14 may be a plurality of annular grooves 23. The plurality of annular grooves 23 is distributed along the fulcrum body 13 to accommodate the at least one rail 7 at specific positions along the fulcrum body 13. Further, a specific annular groove 22 of the plurality of annular grooves 23 is rollably engaged along the at least one rail 7. Thus, the user can alter the balance training for different body postures by using different annular grooves on the rolling fulcrum 12.

Although the invention has been explained in relation to its preferred embodiment, it is to be understood that many other possible modifications and variations can be made without departing from the spirit and scope of the invention.

What is claimed is:

1. A balance board with variable fore-and-aft adjustability comprising:

a board body;

at least one rail;

a first rail support;

a second rail support;

a rolling fulcrum;

a plurality of first slots;

a plurality of second slots;

the board body comprising a first board face and a second board face;

the at least one rail comprising a first rail end and a second rail end;

the first rail support and the second rail support being positioned parallel to each other;

the first rail support and the second rail support being mounted onto the second board face;

the first rail support and the second rail support being positioned offset from each other;

the plurality of first slots being distributed along the first rail support;

the plurality of first slots laterally integrated into the first rail support;

the plurality of first slots being oriented towards the second rail support;

the plurality of second slots being distributed along the second rail support;

the plurality of second slots being laterally integrated into the second rail support;

the plurality of second slots being oriented towards the first rail support;

each of the plurality of first slots being positioned inline with a corresponding second slot from the plurality of second slots;

a specific first slot from the plurality of first slots being releasably engaged by the first rail end;

the corresponding second slot from the plurality of second slots being releasably engaged by the second rail end; and the rolling fulcrum being rollably mounted along the at least one rail, opposite to the board body.

2. The balance board with variable fore-and-aft adjustability as claimed in claim 1 comprising:

an anti-slip layer;

the anti-slip layer being adhered across the first board face; and the anti-slip layer being coextensive with the first board face.

3. The balance board with variable fore-and-aft adjustability as claimed in claim 1 comprising:

a plurality of anti-slip features;

the plurality of anti-slip features being distributed across the first board face; and the plurality of anti-slip features being adhered onto the first board face.

4. The balance board with variable fore-and-aft adjustability as claimed in claim 1 comprising:

the board body comprising a first board end and a second board end;

the first rail support and the second rail support being positioned perpendicular to a central lengthwise axis of the board body;

the first rail support being positioned offset from the first board end; and the second rail support being positioned offset from the second board end.

5. The balance board with variable fore-and-aft adjustability as claimed in claim 1, wherein a transversal cross-sectional shape of each of the plurality of first slots is configured to receive a transversal cross-sectional shape of the first rail end.

6. The balance board with variable fore-and-aft adjustability as claimed in claim 1, wherein a transversal cross-sectional shape of each of the plurality of second slots is configured to receive a transversal cross-sectional shape of the second rail end.

7. The balance board with variable fore-and-aft adjustability as claimed in claim 1 comprising:

the rolling fulcrum comprising a fulcrum body and at least one annular groove;

the at least one annular groove being laterally integrated around the fulcrum body;

the at least one annular groove being centrally positioned along the fulcrum body; and the at least one annular groove being rollably engaged along the at least one rail.

8. The balance board with variable fore-and-aft adjustability as claimed in claim 7 comprising:

the at least one annular groove being a plurality of annular grooves;

the plurality of annular grooves being distributed along the fulcrum body; and a specific annular groove of the plurality of annular grooves being rollably engaged along the at least one rail.

9. A balance board with variable fore-and-aft adjustability comprising:

a board body;

at least one rail;

a first rail support;

a second rail support;

a rolling fulcrum;

a plurality of first slots;

a plurality of second slots;

the board body comprising a first board face, a second board face, a first board end, and a second board end;

the at least one rail comprising a first rail end and a second rail end;

the first rail support and the second rail support being positioned perpendicular to a central lengthwise axis of the board body;

the first rail support and the second rail support being positioned parallel to each other;

the first rail support and the second rail support being mounted onto the second board face;

the first rail support and the second rail support being positioned offset from each other;

the first rail support being positioned offset from the first board end;

the second rail support being positioned offset from the second board end;

the plurality of first slots being distributed along the first rail support;

the plurality of first slots laterally integrated into the first rail support;

the plurality of first slots being oriented towards the second rail support;

the plurality of second slots being distributed along the second rail support;

the plurality of second slots being laterally integrated into the second rail support;

the plurality of second slots being oriented towards the first rail support;

each of the plurality of first slots being positioned inline with a corresponding second slot from the plurality of second slots;

a specific first slot from the plurality of first slots being releasably engaged by the first rail end;

the corresponding second slot from the plurality of second slots being releasably engaged by the second rail end; and the rolling fulcrum being rollably mounted along the at least one rail, opposite to the board body.

10. The balance board with variable fore-and-aft adjustability as claimed in claim 9 comprising:

an anti-slip layer;

the anti-slip layer being adhered across the first board face; and the anti-slip layer being coextensive with the first board face.

11. The balance board with variable fore-and-aft adjustability as claimed in claim 9 comprising:

a plurality of anti-slip features;

the plurality of anti-slip features being distributed across the first board face; and the plurality of anti-slip features being adhered onto the first board face.

12. The balance board with variable fore-and-aft adjustability as claimed in claim 9, wherein a transversal cross-sectional shape of each of the plurality of first slots is configured to receive a transversal cross-sectional shape of the first rail end.

13. The balance board with variable fore-and-aft adjustability as claimed in claim 9, wherein a transversal cross-sectional shape of each of the plurality of second slots is configured to receive a transversal cross-sectional shape of the second rail end.

14. The balance board with variable fore-and-aft adjustability as claimed in claim 9 comprising:

the rolling fulcrum comprising a fulcrum body and at least one annular groove;

the at least one annular groove being laterally integrated around the fulcrum body;

the at least one annular groove being centrally positioned along the fulcrum body; and the at least one annular groove being rollably engaged along the at least one rail.

15. The balance board with variable fore-and-aft adjustability as claimed in claim 14 comprising:

the at least one annular groove being a plurality of annular grooves;

the plurality of annular grooves being distributed along the fulcrum body; and a specific annular groove of the plurality of annular grooves being rollably engaged along the at least one rail.

16. A balance board with variable fore-and-aft adjustability comprising:

a board body;

at least one rail;

a first rail support;

a second rail support;

a rolling fulcrum;

a plurality of first slots;

a plurality of second slots;

the board body comprising a first board face, a second board face, a first board end, and a second board end;

the at least one rail comprising a first rail end and a second rail end;

the first rail support and the second rail support being positioned perpendicular to a central lengthwise axis of the board body;

the first rail support and the second rail support being positioned parallel to each other;

the first rail support and the second rail support being mounted onto the second board face;

the first rail support and the second rail support being positioned offset from each other;

the first rail support being positioned offset from the first board end;

the second rail support being positioned offset from the second board end;

the plurality of first slots being distributed along the first rail support;

the plurality of first slots laterally integrated into the first rail support;

the plurality of first slots being oriented towards the second rail support;

the plurality of second slots being distributed along the second rail support;

the plurality of second slots being laterally integrated into the second rail support;

the plurality of second slots being oriented towards the first rail support;

each of the plurality of first slots being positioned inline with a corresponding second slot from the plurality of second slots;

a transversal cross-sectional shape of each of the plurality of first slots is configured to receive a transversal cross-sectional shape of the first rail end;

a specific first slot from the plurality of first slots being releasably engaged by the first rail end;

a transversal cross-sectional shape of each of the plurality of second slots is configured to receive a transversal cross-sectional shape of the second rail end;

the corresponding second slot from the plurality of second slots being releasably engaged by the second rail end; and the rolling fulcrum being rollably mounted along the at least one rail, opposite to the board body.

17. The balance board with variable fore-and-aft adjustability as claimed in claim 16 comprising:

an anti-slip layer;

the anti-slip layer being adhered across the first board face; and the anti-slip layer being coextensive with the first board face.

18. The balance board with variable fore-and-aft adjustability as claimed in claim 16 comprising:

a plurality of anti-slip features;

the plurality of anti-slip features being distributed across the first board face; and the plurality of anti-slip features being adhered onto the first board face.

19. The balance board with variable fore-and-aft adjustability as claimed in claim 16 comprising:

the rolling fulcrum comprising a fulcrum body and at least one annular groove;

the at least one annular groove being laterally integrated around the fulcrum body;

the at least one annular groove being centrally positioned along the fulcrum body; and the at least one annular groove being rollably engaged along the at least one rail.

20. The balance board with variable fore-and-aft adjustability as claimed in claim 19 comprising:

the at least one annular groove being a plurality of annular grooves;

the plurality of annular grooves being distributed along the fulcrum body; and a specific annular groove of the plurality of annular grooves being rollably engaged along the at least one rail.

* * * * *